United States Patent [19]

Hujik et al.

[11] 4,095,536

[45] Jun. 20, 1978

[54] DISCHARGE AND CUTTING APPARATUS FOR TANDEM SEWING MACHINE

[75] Inventors: Ladislav Hujik, Batawa; Miroslav Baran, Trenton, both of Canada

[73] Assignee: Bata Shoe Company, Inc., Belcamp, Md.

[21] Appl. No.: 731,543

[22] Filed: Oct. 13, 1976

[51] Int. Cl.[2] ..... D05B 21/00

[52] U.S. Cl. ..... 112/121.26; 112/121.29; 112/130; 83/110

[58] Field of Search ..... 112/130, 121.12, 121.29, 112/121.15, 121.27, 209, 208, 121.26, 207, 205, 203; 83/110

[56] References Cited

U.S. PATENT DOCUMENTS

| | | | |
|---|---|---|---|
| 2,666,003 | 1/1954 | Dougherty | 266/110 X |
| 3,476,003 | 11/1969 | Adams | 112/130 X |
| 3,487,798 | 1/1970 | Marforio | 112/130 X |
| 3,675,604 | 7/1972 | Frost | 112/130 X |
| 3,726,240 | 4/1973 | Emich | 112/121.29 X |
| 3,773,002 | 11/1973 | Burton | 112/121.29 X |
| 3,871,309 | 3/1975 | Frost | 112/130 X |
| 3,884,166 | 5/1975 | Rinehimer et al. | 112/130 X |
| 3,886,879 | 6/1975 | Frost et al. | 112/130 |
| 3,970,021 | 7/1976 | Meadows et al. | 112/130 |
| 3,973,506 | 8/1976 | Rinehimer et al. | 112/130 |

*Primary Examiner*—George H. Krizmanich

*Attorney, Agent, or Firm*—Holman & Stern

[57] ABSTRACT

A discharge and cutting apparatus for attachment to the trailing end of a tandem sewing machine, which is used to sew footwear components and apply tape to the seam, includes a frame having a base plate contiguous with the work surface of the sewing machine for receiving the footwear components interconnected by the continuous strip of tape, a pair of opposed pressure rollers for drawing the components and tape from the sewing machine, a smaller pressure roller driven in synchronism with the first pressure rollers for maintaining the components and tape under tension, a cutting device including an electromagnetically operated blade for chopping the tape at the leading and trailing edges of the components, and a second pair of opposed small pressure rollers for receiving the components and tape from the cutting operation and discharging the components and tape from the apparatus. A transmission interconnecting all of the rollers and the sewing machine drive ensures that the pressure rollers are driven in synchronism with the sewing machine and with each other. By reducing the size and thus increasing the rotational speed of the pressure rollers in the direction of travel of the tape and components, the material being treated is kept under constant tension during discharge and cutting.

8 Claims, 6 Drawing Figures

DISCHARGE AND CUTTING APPARATUS FOR TANDEM SEWING MACHINE

BACKGROUND OF THE INVENTION

1. Field of the Invention

This invention relates to a discharge and cutting apparatus for footwear sewing machines and in particular to an apparatus for removing footwear components interconnected by a tape from a tandem sewing machine and cutting the tape.

2. Description of the Prior Art

In the production of uppers for basketball or tennis shoes or boots, canvas quarters are first joined together by a single line of stitching parallel to the back or heel edges of the quarters. The quarters are then spread apart, each fabric edge outside the seam is folded flat against its respective quarter, a strip of tape is applied to the seam to cover the folded edges, and the tape is secured to the quarters by two parallel lines of stitching, one on each side of the first seam.

The stitching and tape applying operations are performed in a so-called tandem sewing machine, which includes a pair of sewing machines. A first sewing machine performs the first stitching operation, following which the shoe components are fed along a base plate where guides separate the components and fold the edges outside the seam flat against their respective quarters. Tape from a large roll is fed from beneath the base plate against the folded quarter edges, and the components and tape are fed into a two needle sewing machine for the last two stitching operations, which are performed simultaneously. The components are then discharged from the tandem sewing machine for separation, i.e., cutting of the tape at the leading and trailing edges of each component and further processing. Such further processing includes completion of the upper, lasting and sole moulding.

In the recent past, the components, interconnected sausage-fashion by the tape were separated manually using scissors. More recently, a variety of cutting devices have been produced for accurately cutting the tape at the leading and trailing edges of the footwear components (see, for example, applicant's Canadian Pat. No. 932,650, issued Aug. 28, 1973).

Even with such cutting devices, there still exists a need for controlled discharge of the footwear components and tape from the tandem sewing machine, while accurately severing the tape at the leading/trailing edges of the components. The object of the present invention is to provide an apparatus for accepting the sewed footwear components and tape from the second sewing machine and positively feeding the components and tape through cutting operations for discharge into separate containers, where the components can be fed to further processing operations and the tape ends removed by cutting can be discarded.

SUMMARY OF THE INVENTION

Accordingly, the present invention is a discharge and cutting apparatus for attachment to a tandem sewing machine including frame means; a work surface in the frame means for receiving footwear components interconnected by a continuous strip of tape; first feed means for gripping the components and tape; cutting means for cutting said tape at the leading and trailing edges of said components; guide means for guiding said components past said cutting means, second feed means for receiving said components and tape following a cutting operation and discharging said components and tape from the apparatus; and drive means for operating said first and second feed means in synchronism with each other and with the tandem sewing machine.

In the preferred form of the present invention, the frame means is a rectangular frame, which is pivotally mounted on a table carrying the tandem sewing machine, whereby the working elements of the apparatus can be rotated away from the tandem sewing machine for adjustment and for servicing. The feed means are simply opposed pressure rollers, some having friction surfaces for positively gripping the components and tape. The cutting means is a chopper, i.e., an electromagnetically operated blade, which rapidly chops the tape at the leading and trailing edges of the interconnected footwear components. A control system is provided for the cutting device, including photo sensors in the work surface of the apparatus for detecting the leading and trailing edges of the components and triggering a cutting operation. The provision of a plurality of photo sensors permits the use of the apparatus with a large number of different components, i.e. components having leading and trailing edges with a variety of configurations. The drive means is preferably the motor of the second sewing machine and a transmission interconnecting the motor and selected of the pressure rollers. Thus, feeding of the components and tape through the cutting and discharge operations occurs only when the sewing machine is in use. Moreover, the rates of cutting and discharging are directly proportional to the speed of operation of the tandem sewing machine. Some machine operators are quicker than others, but the speed of the operator is of no consequence, since the apparatus operates in synchronism with the tandem sewing machine.

The photo sensor control system employed in the apparatus of the present invention is also believed to be unique. The use of a multi-photo sensor system enables cutting of the tape close to the leading or trailing edges of the components regardless of the profile of such edges.

The invention will now be described in greater detail with reference to the accompanying drawings, which illustrate prior art and a preferred embodiment of the invention, and wherein:

DESCRIPTION OF THE PREFERRED EMBODIMENT

Figure 1:
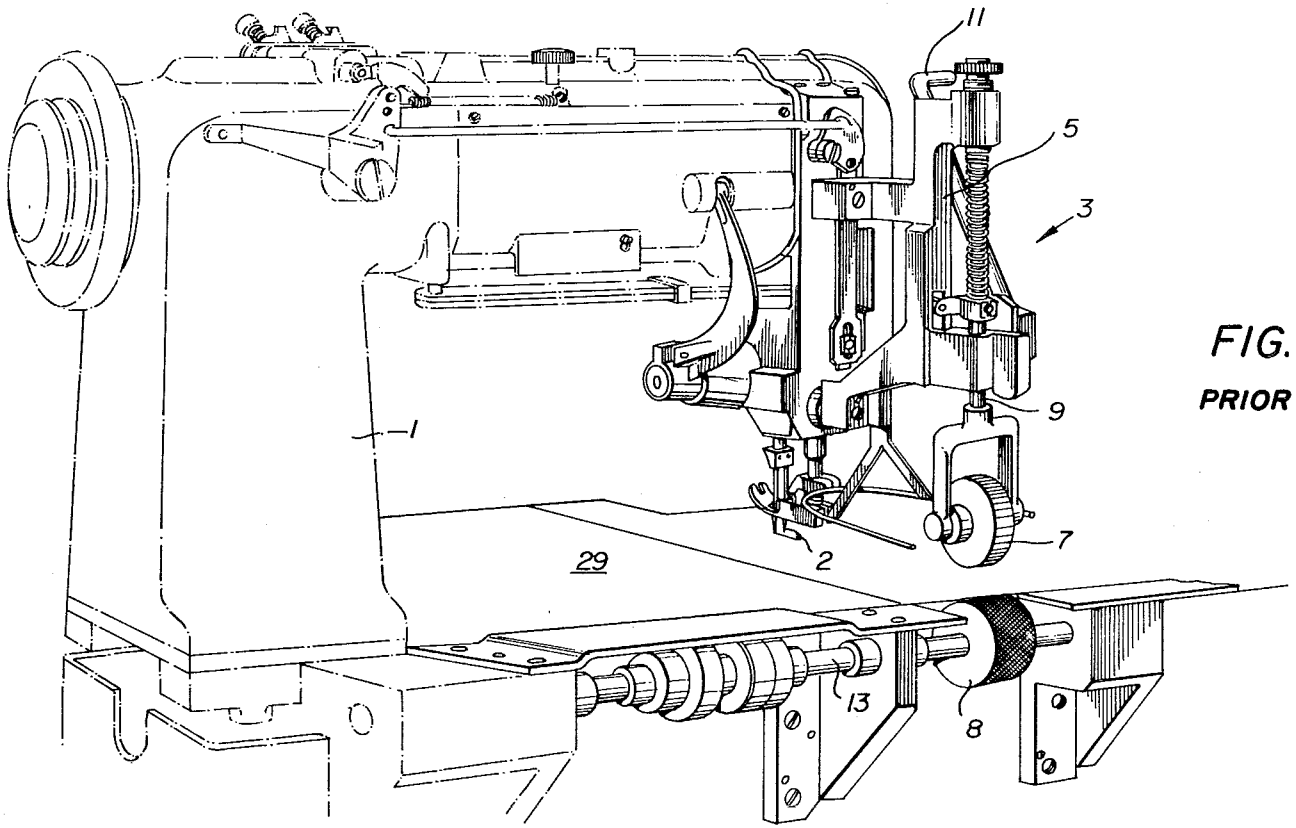
FIG. 1 PRIOR ART
FIG. 1 is a perspective view of the discharge end of a conventional tandem sewing machine.

With reference to FIG. 1, as mentioned hereinbefore, a conventional tandem sewing machine includes a second sewing machine 1 with a pair of needles 2 for sewing a tape over the folded edges of a pair of interconnected shoe components. Upon leaving the sewing machine 1, the tape and footwear components are maintained under pressure by a pressure device, generally indicated at 3, which includes a frame 5 attached to the sewing machine 1, and a pair of vertically opposed rollers 7 and 8.

The top roller 7 is rotatably mounted on the bottom end of a rod 9, which is slidably mounted in the frame 5. By rotating a lever 11, the roller 7 is pressed against the driven knurled roller 8 to maintain the tape and footwear components under tension during discharge from the tandem sewing machine. The knurled roller 8 is mounted on a shaft 13, which is driven in synchronism with the needles 2, so that the roller 8 is rotated only when the sewing machine is in operation. The drive (not shown) for the shaft 13 forms part of the sewing machine 1 and is an off the shelf item, being an element of the tandem sewing machine.

Figure 2:
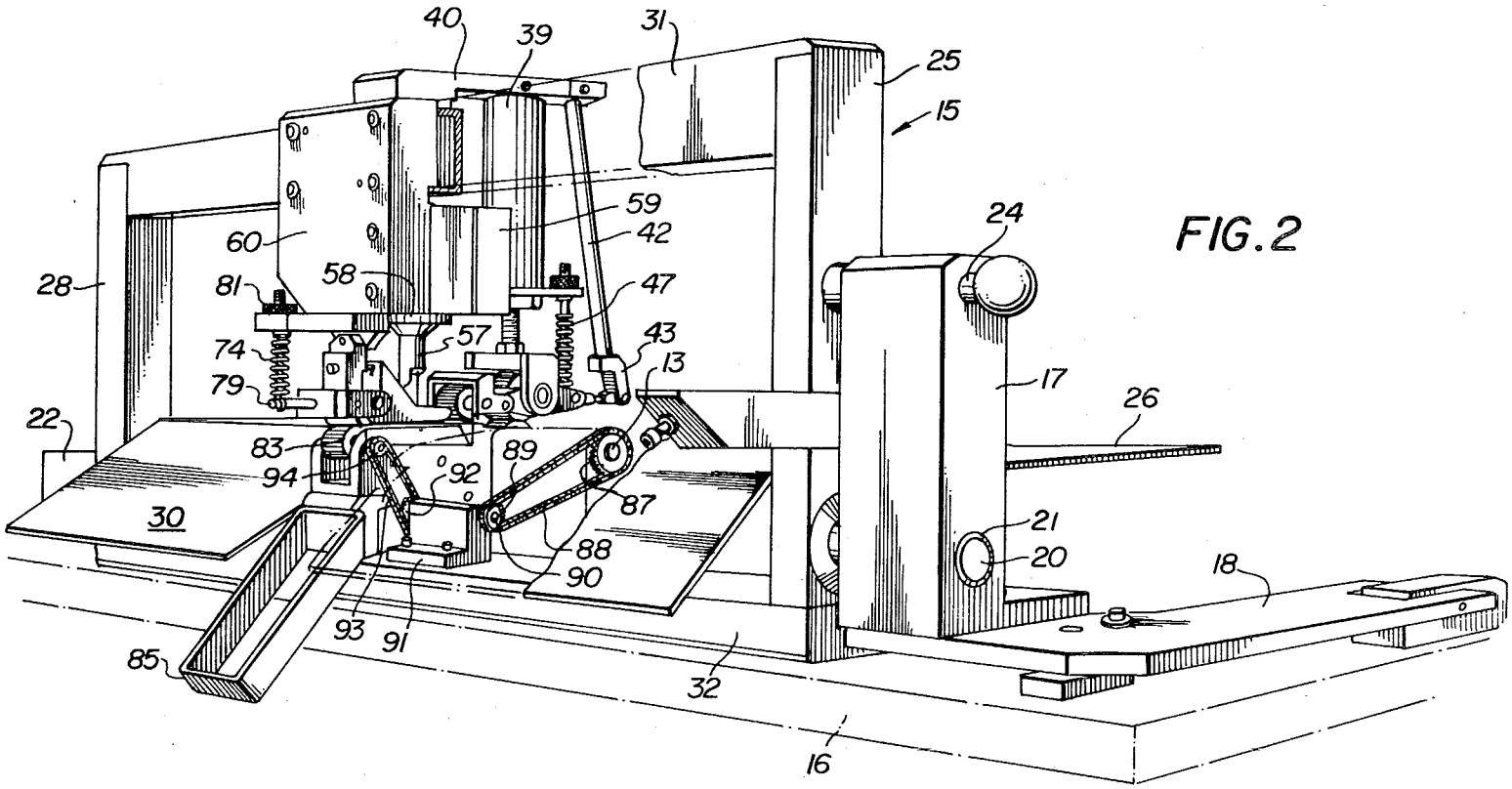
FIG. 2 is a perspective view of the apparatus of the present invention taken from the right of the discharge end.
Figure 3:
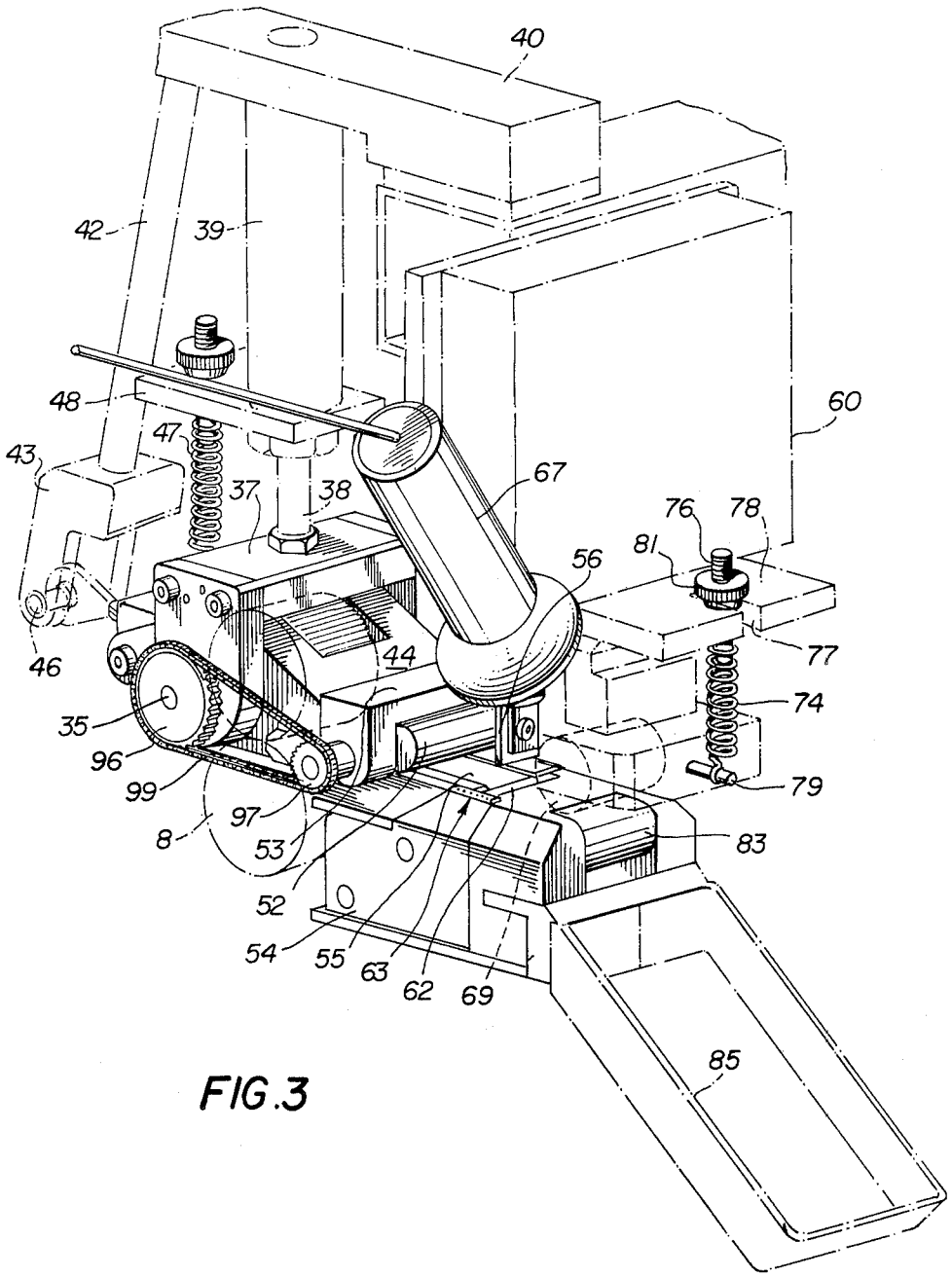
FIG. 3 is a perspective view of the apparatus of FIG. 2 taken from the left of the discharge end, with parts omitted.
Figure 4:
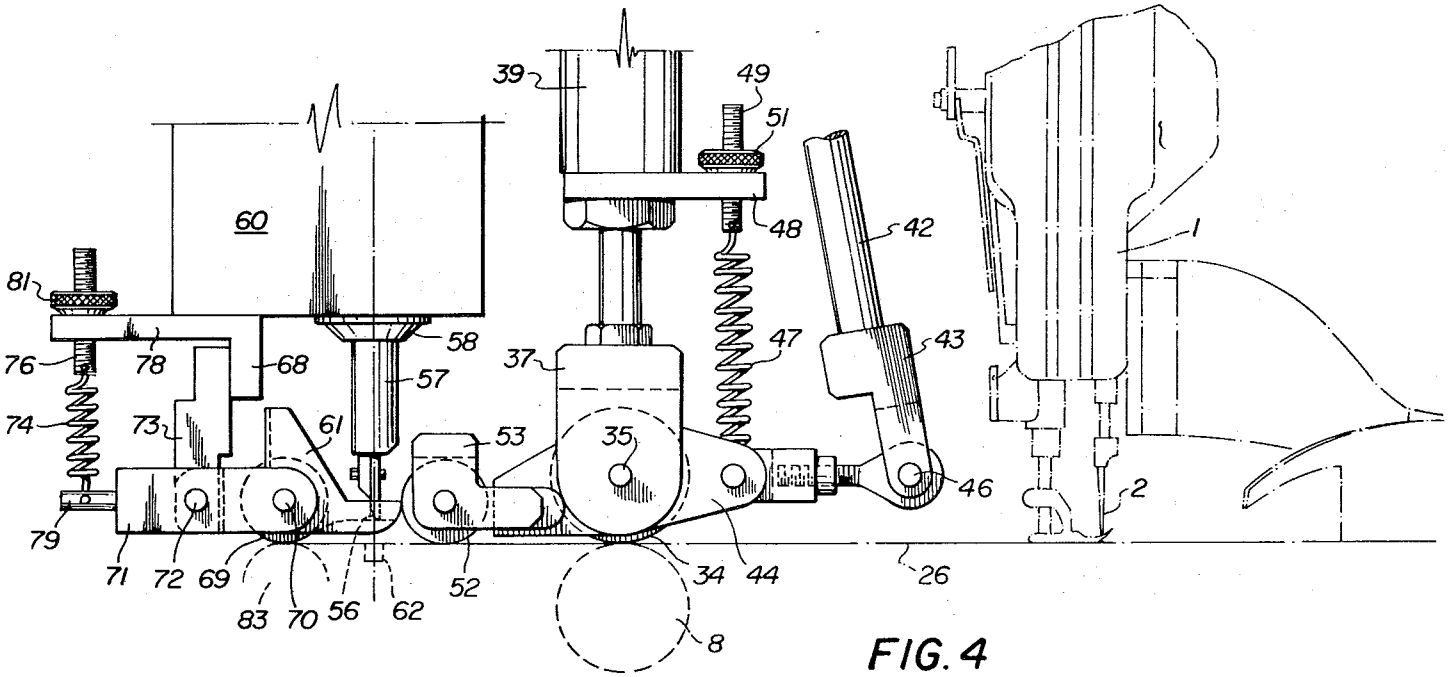
FIG. 4 is an elevation of the feed elements of the apparatus of FIGS. 2 and 3 with one sewing machine of a tandem sewing machine shown in phantom outline.

Referring now to FIGS. 2, 3 and 4, the preferred form of apparatus in accordance with the invention includes a rectangular frame, generally indicated at 15, for pivotal mounting on a table 16 normally provided with the tandem sewing machine. In the present case, a support post 17 at one end of a plate 18 pivotally supports the frame 15 for rotation about a horizontal axis defined by a shaft 20 passing through a bushing 21 in the post. A post or block 22 at the opposite end of the frame 15 contains a similar shaft arrangement (not shown), whereby the frame 15 can be rotated outwardly and downwardly for servicing. Of course, the frame could be pivotally mounted for rotation about a vertical axis, but that would necessitate the disconnecting of drive elements, as will become apparent from the following text. The frame 15 is locked in position by a bolt 24 extending through the post 17 into a threaded aperture (not shown) in one side 25 of the frame 15.

A work surface in the form of a plate 26 extends between sides 25 and 28 of the frame, and, in use, is aligned with the base plate 29 (FIG. 1) of the tandem sewing machine. The plate is horizontal, with an inclined trailing end 30, which acts as a ramp for discharging separated sewn footwear components. A top 31 and bottom 32 of the frame 15 support most of the remaining components of the apparatus.

A first set of feed or pressure rollers 8 and 34 are provided at the leading end of the apparatus, following the second sewing machine 1 of the tandem sewing machine system. One of the rollers 8 is mounted on the drive shaft 13 (FIG. 1) which forms part of the sewing machine 1, beneath the work surface 26 and base plate 29. As mentioned hereinbefore, the shaft 13 and knurled roller 8 were provided with the tandem sewing machine system (manufactured by Singer), and it was necessary for the inventor to make minor alterations, to extend the outer end of the shaft 13 beyond the path of stitching of the sewing machine for the purpose described hereinafter. The shaft 13 is driven in synchronism with the needles 2, and provides the only drive for all elements of the apparatus, except for the cutting device to be described hereinafter.

The pressure roller 34 is mounted above the roller 8 for bearing against the driven roller and drawing sewn components and tape out of the tandem sewing machine system. The roller 34 is provided with stub axis 35 for rotatably mounting the roller in a U-shaped bracket 37 on one end of a piston rod 38, the other end of which extends into a pneumatic cylinder 39 securely mounted on the bottom of an arm 40 extending outwardly from the top 31 of the frame 15. By changing the fluid pressure in the cylinder 39, the pressure of the roller 34 on the roller 8 can be varied. The arm 40 also pivotally supports a downwardly extending rod 42, the lower end of which is provided with a clevis 43 for pivotally supporting the leading end of a roller frame 44 on a pin 46. The leading end of the roller frame 44 is biased upwardly by a helical spring 47 interconnecting the roller frame and a plate 48 on the bottom end of the cylinder 39. The top end of the spring 47 is secured in a screw 49 which passes through the plate 48 and is held therein by a knurled adjustment nut 51. By turning the nut 51, the tension on the roller frame 44 can be adjusted, and consequently the pressure of the roller 52 on the work surface or components and tape varied. The pressure may require adjustment depending upon the thickness of the components and tape being fed through the apparatus.

The roller frame 44 pivots around the stub axles 35 and rotatably supports a small pressure roller 52 in a bracket 53 at its trailing end above the work surface 26. Thus, by adjusting the spring tension on the leading end of the roller frame 44, the pressure of the roller 52 on the work surface or footwear components passing between the roller and the work surface can be changed.

The base of the apparatus is in the form of a block 54 mounted on the bottom 32 of the frame 15. A groove 55 of rectangular cross-sectional configuration in the top surface of the block 54 extends longitudinally in the direction of travel of the tape and footwear components beneath and beyond the roller 52 for receiving the tape, and guiding the tape and footwear components beneath a cutting device.

Figure 5:
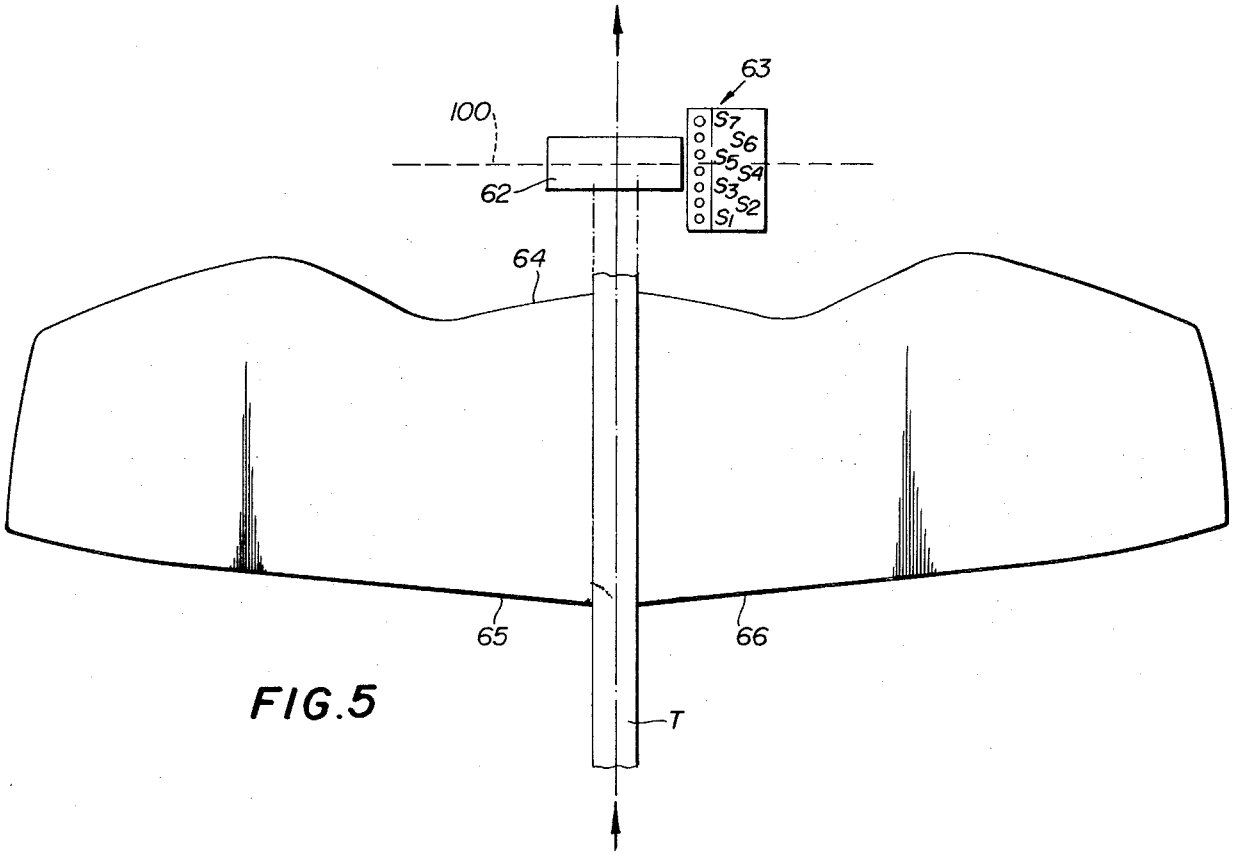
FIG. 5 is a plan view of a pair of sewn and taped footwear components at the cutting location of the apparatus of FIGS. 2 to 4.

Thus, the pressure roller 52 is followed in the direction of travel of the footwear components and tape by the groove 55 and by a cutting device of the type described completely in applicant's Canadian Pat. No. 932,650 issued Aug. 28, 1973. The cutting device includes a blade 56 on the end of a rod 57 which extends into a casing 58 mounted in a split extension 59 of a block 60 on the frame 15. The blade 56 of the cutting device is surrounded by a generally L-shaped fence 61 with a convex leading end for ensuring that the footwear components and tape do not curve up into the area of the block extension 59. The portion of the rod 57 in the casing 58 acts as the core of an electromagnet, which includes a coil (not shown) operated by a discharging condenser described hereinafter in the description of the electrical control circuit. The blade 56 is opposed by a hard metal insert 62 in the base block 54. Photo sensors, generally indicated at 63 (FIGS. 3 and 5), are also provided in the block 54 for detecting leading and trailing edges 64 and 65, respectively of sewn footwear components 66 (FIG. 5). In the embodiment illustrated in FIG. 5, seven photo sensors $S_1$ to $S_7$ are provided. However, any number of photocells can be employed. A light source 67 is mounted on the block 60 above the photo sensors 63.

An L-shaped plate 68 is mounted on the bottom of the trailing end of block 60 for supporting a second small pressure roller 69 and the fence 61. The roller 69 has stub axles 70 rotatably mounted in a bracket 71, which is pivotally mounted on a pin 72 in a vertical arm 73 extending downwardly from the plate 68. A helical spring 74 extends between a screw 76 passing through a slot 77 in a horizontal arm 78 of the plate 68 and a pin 79 in the trailing end of the bracket 71. The screw 76 is retained in the slot 77 by a knurled adjustment nut 81. Rotation of the adjustment nut 81 causes the bracket 71 to pivot about the pin 72, and increases or decreases the pressure of the roller 69 on a bottom driven roller 83, depending on the thickness of the components and tape being discharged from the sewing machine. The rollers 69 and 83 are followed by a rectangular slide 86, which has open top and bottom ends, and extends downwardly beneath and beyond the end of the ramp 30 at the trailing end of the block 54.

Each of the rollers 8 and 83 are driven by a common drive including the shaft 13 of the sewing machine 1. As mentioned hereinbefore, the roller 8 is mounted on the shaft 13, which is extended past the roller 8. A toothed wheel 87 is mounted on the outer free end of the shaft 13, and is connected by a chain 88 to a second toothed wheel 89, a shaft 90 in a block 91 on the bottom 32 of frame 15, a third toothed wheel 92, a chain 93 and a fourth toothed wheel 94 to an outboard end of the stub axle on the roller 83. The rollers 34 and 52 are interconnected by toothed wheels 96 and 97, respectively on their stub axles, and a chain 99. Because the roller 34 presses against the roller 8 or the material passing between the rollers, driving of the roller 8 causes the roller 34 to rotate, and such motion is transmitted through the chain 99 to the roller 52. At the same time, the transmission described above causes the roller 83 to rotate, and the latter rotates roller 69. Thus, all of the rollers 8, 34, 52, 69 and 83 rotate in synchronism with each other and are driven in synchronism with the sewing machine. The rollers 52, 69 and 83 are smaller than the rollers 8 and 34, so that the small rollers rotate more quickly than the larger rollers and material passing under or between the rollers is constantly being pulled out of the sewing machine and rapidly discharged.

Since the roller 52 is smaller than the roller 34 and the smaller roller is driven by the larger roller through the chain 99, and gears 96 and 97 having the same size ratio as the rollers, the surface speed of the roller 52 is much faster than that of the roller 34. Thus, the roller 52 will maintain tension on the material passing between the rollers 34 and 52. Since the components 66 and tape T are separated by the blade 56, it is important to provide feed means following the blade 56 in the path of travel of the components and tape. The rollers 69 and 83 constitute such feed means. The rollers 69 and 83 are also smaller than the rollers 8 and 34, and thus have higher surface speeds than such rollers, maintaining tension on the components passing the blade 56.

The operation of the apparatus will now be described in conjunction with a description of the electrical control circuit for the cutting devices.

In operation, each time an operator starts the tandem sewing machine system, the rollers are rotated to receive and feed the footwear components and tape. The operator feeds pairs of footwear components (quarters) through the first sewing machine of the tandem sewing machine making a single heel seam, and, from that point, the operation becomes completely automatic. The components 66 are opened, i.e., spread apart flat on the base plate, the edges outside the seam are folded flat against the quarters, a strip of tape T is applied from beneath the table to cover the folded edges, and the tape is sewn onto the quarters with two parallel lines of stitching by the second sewing machine 1, at which point the apparatus of the present invention assumes control of the components and tape.

The components 66 leaving the second sewing machine 1 pass between the rollers 8 and 34, and, since they are still connected sausage-fashion to the remaining components by tape T, help to draw the remaining components past the second sewing machine. The components 66 and tape T then pass beneath the roller 52 where tension on the components and tape is maintained. The tape T enters the groove 55 in the block 54 which guides the tape and components to the cutting device. The leading edge 64 of the first components 66 then occludes one of the photo sensors 63 to effect a cutting action, in which the tape projecting beyond the leading edge 64 of the sewn components is severed. The severed tape and sewn components then proceed between the rollers 69 and 83, and when a selected photo sensor 63 is uncovered, a second cut is effected to sever the tape at the trailing edge 65 of the sewn components 66. The scrap of tape in front of the leading edge 64 of the sewn components, after passing between the rollers 69 and 83 drops through the slide 85 into a bin (not shown). The separated sewn components slide down the slide with their outer free edges on the ramp 30 and fall into a separate bin. When the bins become full, they are removed, the components passing to further processing and the tape ends being discarded.

Figure 6:
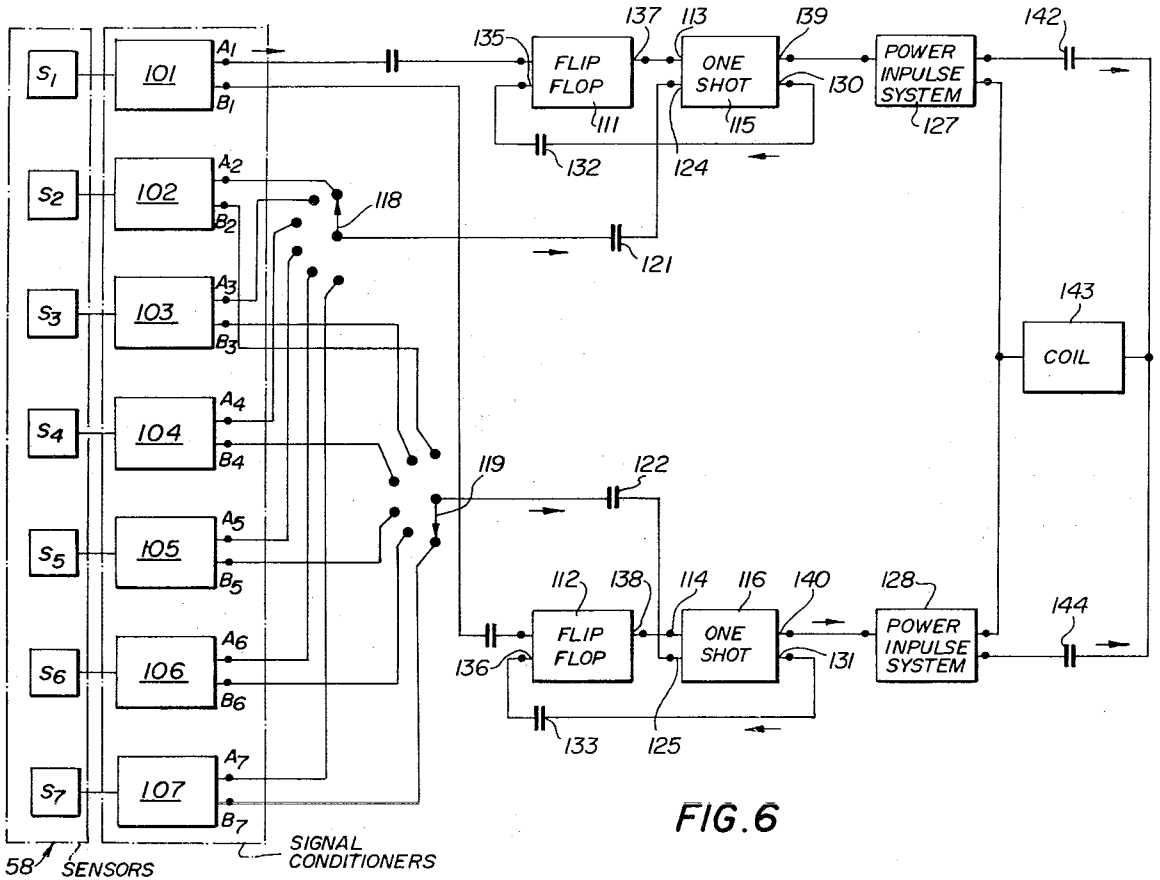
FIG. 6 is a circuit diagram of the control system used in the apparatus of FIGS. 2 to 4.

With reference to FIGS. 5 and 6, the use of a plurality of photo sensors 63 enables the cutting of tape T very close to the leading and trailing edges 64 and 65, respectively of sewn components 66 regardless of the shape or dimensions of such edges. In theory, any number of photo sensors can be used, but in the preferred form of the apparatus, seven photo sensors $S_1$ to $S_7$ are employed. Following sewing, the edges of the components travel along the row of photo sensors, the functions of which are selected by means of switches, so that the cutting device is activated at the moment when the front or back edge of the components is beneath the blade. The line of photo sensors is parallel to the path of travel of the tape on each side of a cutting line 100, i.e., the line on which the blade 50 strikes the insert 62. The photo sensors are equidistant apart, one half preceding the cutting line 100 and the other half following such line. The leading and trailing edges of the sewn components cover or uncover the sensors $S_1$ to $S_7$ in succession.

Referring to FIG. 6, changes in illumination of the photo sensors are registered by signal conditioners 101 to 107. The outputs $A_1$ to $A_7$ and $B_1$ to $B_7$ of the signal conditioners change from logic level "0" to "1" and from "1" to "0" each time a change in illumination occurs. The sensor $S_1$ with the signal conditioner 101 sets two flip-flops 111 and 112 to open inputs 113 and 114 of monostable multivibrators or so-called one shots 115 and 116. The photocells $S_2$ to $S_7$ in conjunction with signal conditioners 102 to 107 trigger the one shots 115 and 116 via switches 118 and 119, capacitors 121 and 122, and inputs 124 and 125.

The one shots 115 and 116 generate trigger signals for power impulse systems 127 and 128, and, at the same time, reset both flip-flops 111 and 112 via outputs 130, 131, capacitors 132, 133 and inputs 135, 136. Signals from the signal conditioner outputs $A_2$ to $A_7$ control the first cutting action, i.e., the cut at the leading edge 64 of each of the components 66, and signals from outputs $B_2$ to $B_7$ control the second cut at the trailing edge 65 of the components. The selection of which of the photo sensors $S_2$ to $S_7$ are to control the first and second cuts is made by means of the switches 118 and 119.

Every time power is applied to the foregoing system, both flip-flops 111 and 112 are automatically pre-set, so that their outputs 137, 138 have logic "0" level. Thus, both one shots 115 and 116 are closed, and accidental signals fed to inputs 124 and 125 from sensors $S_2$ to $S_7$ cannot start the one shots. When the sensor $S_1$ is blanked or occluded, the $A_1$ output of the signal conditioner 101 will go to the state "0" where its output $B_1$ is at a logic "1" level. Thus, the first one shot 115 is open and ready to make a trigger for the first cut.

Assuming that the sensor $S_2$ is selected as the first cut sensor, and the sensor $S_7$ is selected as the last cut sensor, the switch 118 will be switched to output $A_2$ of the signal conditioner 102 and the switch 119 will be switched to the output $B_7$ of the signal conditioner 107.

If the leading edge of the sewn components occlude the sensor $S_2$, the output $A_2$ of the signal conditioner 102 will become a "0," and consequently the first one shot 115 will generate a trigger pulse on both outputs 139 and 140. The pulse from output 139 will trigger the power impulse signal 127, which discharges a condenser 142 into coil 143 of the cutting device, and the blade 56 will make a first cut at the leading edge 64 of the components 66. At the same time, the pulse from the output 130 resets the first flip-flop 111, and the first one shot 115 is agains closed.

When the trailing edge of the components uncovers the sensor $S_1$, the output $B_1$ of the signal conditioner 101 becomes a "0" level, and the output 138 of the second flip-flop 112 is changed from "0" to "1" to open the second one shot 116. As soon as the sensor $S_7$ is uncovered and illuminated, output $B_7$ of the signal conditioner 107 becomes a "0," and thus the second one shot 116 generates a trigger pulse for the second cut. The pulse from the output 140 triggers the power impulse system 128, which discharges condenser 144 into the coil 143 to make the second cut at the trailing edge 65 of the components 66. At the same time, the pulse from output 131 resets the second flip-flop 112, and the second one shot 116 is closed. The control system is then ready for the next cycle.

There has thus been described a discharge and cutting apparatus for use with a tandem sewing machine which, in conjunction with the sewing machine, automatically draws sewn components and tape from the machine whenever the latter is in operation, severs the tape at the leading and trailing end of each component, and feeds the separated components and tape ends to separate containers. Of course, the cutting device need not take the specific form disclosed herein, and the particular cutting device can be used alone or in other apparatuses.

We claim:

1. A discharge and cutting apparatus for attachment to a sewing machine having a base plate for sewing a tape onto footwear components comprising frame means; a work surface in the frame means for receiving the footwear components and tape, said work surface being contiguous with the base plate of the sewing machine; first feed means in said frame means for gripping components and tape, and drawing the components and tape from the sewing machine under constant tension tension higher than that to which the tape and components are subjected in the sewing machine; cutting means in said frame means for cutting said tape at the leading and trailing edges of said components; second feed means in said frame means for receiving said components and tape following the cutting means in the path of travel of the components and tape, and discharging said components and tape from the apparatus; and drive means in said frame means driven by said sewing machine for operating said first and second feed means in synchronism with each other and with the sewing machine.

2. An apparatus according to claim 1, wherein each of said first and second feed means includes a pair of opposed rollers between which the tape and footwear components can be drawn by rotation of the rollers in opposite directions, the rollers of the first feed means being of larger diameter than the rollers of the second feed means.

3. An apparatus according to claim 2, wherein said first feed means includes a single roller bearing on the work surface downstream of the pair of opposed rollers in the direction of travel of the components and tape, said single roller being of smaller diameter than said pair of opposed rollers for maintaining the components and tape under tension.

4. An apparatus according to claim 3, including means for varying the pressure of said rollers on the components and tape.

5. An apparatus according to claim 1, wherein said work surface includes an inclined ramp downstream of said second feed means in the direction of travel of the components and tape, and a slide for separately discharging said components and tape ends cut from the leading and trailing edges of components.

6. An apparatus according to claim 1, including a control device for said cutting means to ensure cutting of the tape close to the leading and trailing edges of the components, said control device including a plurality of photo sensors in said work surface for detecting the leading and trailing edges of said components and for actuating said cutting means and a light source normally illuminating said photo sensors.

7. An apparatus according to claim 6, wherein said photo sensors are aligned in the direction of travel of said components and tape, a predetermined first of said photo sensors detecting the leading edge of the components and tape, and a predetermined second of said photo sensors detecting the trailing edge of said components and tape, said control means including switch means for determining which of said photo sensors are said first and second photo sensors.

8. An apparatus according to claim 1, including means pivotally mounting said frame means on said sewing machine, whereby the frame means can be swung away from said sewing machine for servicing or adjusting.

* * * * *

UNITED STATES PATENT AND TRADEMARK OFFICE

CERTIFICATE OF CORRECTION

PATENT NO. : 4,095,536
DATED : June 20, 1978
INVENTOR(S) : LADISLAV HUJIK and MIROSLAV BARAN It is certified that error appears in the above-identified patent and that said Letters Patent are hereby corrected as shown below:

Kindly insert the following Priority:

Canada - Application No. 237,494, filed October 14,1975

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*